US005747414A

United States Patent [19]

Ogino et al.

[11] Patent Number: 5,747,414

[45] Date of Patent: May 5, 1998

[54] THERMAL RECORDING SHEET

[75] Inventors: Naomi Ogino, Tokyo; Takashi Oomori, Iwaki; Hiroshi Ueda, Tokyo; Yoshimi Midorikawa, Tokyo; Yutaka Wakita, Tokyo, all of Japan

[73] Assignee: Nippon Paper Industries, Ltd., Tokyo, Japan

[21] Appl. No.: 662,255

[22] Filed: Jun. 14, 1996

[30] Foreign Application Priority Data

Jun. 15, 1995 [JP] Japan ..... 7-147973

[51] Int. Cl.[6] ..... B41M 5/30

[52] U.S. Cl. ..... 503/207; 503/200

[58] Field of Search ..... 503/207, 209, 503/200

[56] References Cited

U.S. PATENT DOCUMENTS

| | | | |
|---|---|---|---|
| 4,168,845 | 9/1979 | Oeda et al. | 503/207 |
| 4,243,716 | 1/1981 | Kosaka et al. | 428/341 |
| 4,311,758 | 1/1982 | Oeda et al. | 428/327 |
| 4,486,763 | 12/1984 | Keishi et al. | 428/207 |
| 4,520,379 | 5/1985 | Glanz et al. | 503/214 |
| 5,130,291 | 7/1992 | Okuda | 503/207 |
| 5,447,900 | 9/1995 | Suzaki et al. | 503/207 |

FOREIGN PATENT DOCUMENTS

| | | | |
|---|---|---|---|
| 0536576 | 4/1993 | European Pat. Off. | 428/207 |
| 0559525 | 9/1993 | European Pat. Off. | 428/207 |
| 8622953 | 7/1978 | Japan | 503/207 |
| 2584554 | 2/1979 | Japan | 503/207 |
| 30943/55 | 3/1980 | Japan | 503/209 |
| 67495/55 | 5/1980 | Japan | 503/207 |
| 156088/55 | 12/1980 | Japan | 503/207 |
| 169087/56 | 12/1981 | Japan | 503/209 |
| 105392/57 | 6/1982 | Japan | 503/226 |
| 115391/57 | 7/1982 | Japan | 503/226 |
| 116688/57 | 7/1982 | Japan | 503/209 |
| 112082/04 | 4/1992 | Japan | 503/226 |
| 2007858 | 5/1979 | United Kingdom | 428/207 |

OTHER PUBLICATIONS

Patent Abstracts of Japan, vol. 007, No. 110 (M–214), 13 May 1983.

JP 58 031794 A (Ricoh KK), 24 Feb. 1983.

Database WPI, Section Ch, Week 8311, Derwent Pub. Ltd., London, GB.

JP 58 020 492 A (Ricoh KK), 5 Feb. 1983.

*Primary Examiner*—Bruce H. Hess

*Attorney, Agent, or Firm*—Sherman and Shalloway

[57] ABSTRACT

In a thermal recording sheet including a substrate having thereon a thermal color developing layer containing colorless or pale colored basic achromatic dye and an organic color developer, the thermal color developing layer contains aluminium hydroxide and a urea-formaldehyde resin pigment. The thermal recording sheet is small in abrasion of the recording head and adherence of depositions to the head even after long-run recording, and friction staining in unrecorded portion due to the recording head and change in gloss in unrecorded portion during recording are small.

19 Claims, No Drawings

THERMAL RECORDING SHEET

FIELD OF THE INVENTION

This invention relates to a thermal recording sheet recorded by heating with a thermal pen, thermal recording head, or the like, more specifically to a thermal recording sheet which is small in abrasion of the head and generation of work-up substances (depositions) during recording for an extended period of time and prevented from staining and changes in gloss in unrecorded portion due to rubbing with the recording head during recording.

BACKGROUND OF THE INVENTION

In general, a thermal recording sheet is normally obtained by mixing a colorless or pale colored basic dye precursor and a color developer such as a phenolic compound, each dispersed to fine particles and mixed, adding a binder, a filler, a sensitizer, a slip agent, and other additives to form a coating color, and coating the coating color on a substrate such as paper, synthetic paper, films, or plastics, which develops a color by a momentary chemical reaction caused by heating with thermal pen, a thermal head, or the like to obtain a recorded image. These thermal recording sheets are applied in a wide variety of areas such as measuring recorders, terminal printers for computers, facsimiles, automatic ticket venders, and bar code labels. However, with recent diversification of these recording devices and advance towards higher performance, quality requirements for thermal recording sheet have become higher and more difficult to achieve.

In particular, since thermal recording is simple in device structure and reliable, and does not require replacement of ink or toner other than paper which are required in other recording methods, it becomes increasingly used in applications requiring maintenance-free operation. With such expansion of market, development of a thermal recording sheet is in demand which has good head matching, not affecting the service life of the head of the recording device, is good in running stability and recording characteristics.

Requirements for such a thermal recording sheet include the following:

(1) The thermal recording sheet is small in abrasion of the recording head during an extended recording run, (2) Small adherence of depositions (work-up substances) to the recording head during an extended recording run, (3) Has no meander of paper or paper feed trouble, and paper running is stable, (4) Sufficient recording density, (5) Small in uneven recording and has uniform recording image, (6) No generation of staining in unrecorded portion even by friction with the recording head, and small in changes in surface gloss due to friction with the head.

To meet such requirements, various methods have heretofore been proposed. For example, a thermal recording material described in Japanese Patent Publication 43-4160 uses a sensitizer. However, because this thermal recording material has a problem in that it is insufficient in sensitivity, the recording sheet holding pressure of the thermal pen or thermal head must be enhanced, or the flatness of the recording sheet be increased to ensure the recording characteristics. As a result, the recording sheet contacts closer with the recording head, and the head tends to be worn out.

In Japanese Patent Laid-open Publication (OPI) 56-169087 or 53-86229, melting points of the dye or color developer are decreased or a sensitizer is added to decrease the melting point at color development, thereby increasing the color developing sensitivity, or a heat blocking layer is provided between the thermal color developing layer and the substrate to increase the heat storage capacity of the color developing layer, thereby increasing the sensitivity. In these cases, the recording characteristics can be ensured even when the recording head is not contacted strongly against the recording sheet. However, it has a problem in that a color is developed by a frictional heat of the recording head with the recording sheet surface resulting in a background staining, or the gloss of the recording surface is enhanced by friction with the recording head, and the properties of the recording sheet are impaired. Further, in extended recording run, since the materials on the color developing layer tend to melt, part of the heat sensitive materials adheres to the head surface in the subsequent solidification step, resulting in adherence of depositions, which disturbs heat transfer from the recording head to the recording sheet or degrades the image quality.

On the other hand, Japanese OPI 57-116688 proposes that styrene-methacrylic acid copolymer as organic particles is added to suppress abrasion of the recording head and adherence of depositions. However, organic particles are weak to heat as compared with inorganic particles and, in particular, under the recording heads the temperature increases close to 200° C. even instantaneously, the organic particles themselves soften or deteriorate, resulting in conspicuous sticking. Further, Japanese OPI 55-67495 describes that cross-linked urea-formaldehyde polymer particles are contained in the color developing layer, and Japanese OPI 54-25845 describes that a urea-formaldehyde resin pigment with an oil absorptivity of more than 100-ml/100 g is contained in the color developing layer to improve adherence of depositions. However, the effect is not sufficient, and since the urea-formaldehyde resin pigment itself is in a bulky form, the resulting recording sheet has been insufficient in terms of the color developing sensitivity and image uniformity.

Still further, Japanese OPIs 55-30943 and 55-156088 individually use aluminium hydroxide and inorganic particles having a hardness of less than 3 in Mohs scale to reduce abrasion. However, the inorganic particles are stable to heat as compared with organic particles but, since they are high in hardness, they have been insufficient to suppress head abrasion during an extended recording run.

Yet further, in Japanese OPIs 57-115391 and 57-105392, an overcoating layer is provided on the thermal recording layer in order to suppress adherence of depositions and sticking to the recording head. Yet further, in Japanese OPI 4-112082, urea-formaldehyde resins having a particle diameter of less than 10 μm and an oil absorption of 100 to 500-ml/100 g are contained in the overcoating layer. However, when an overcoating layer is provided, there is a problem in that, in addition to the fact that heat transfer to the color developing layer is disturbed to reduce the sensitivity, the production process to form the overcoating layer is added which increases the production cost.

As described above, conventional thermal recording sheets have various problems, and recording sheets having sufficient head matching, running stability, and recording characteristics could not be obtained. Therefore, a primary object of the present invention is to provide a thermal recording sheet which is small in abrasion of the recording head, adherence of depositions, and occurrence of sticking, and is prevented from staining and changes in gloss in unrecorded portion due to friction with the recording head during recording.

SUMMARY OF THE INVENTION

Under the above-described circumstances, the inventors have conducted intensive studies and found that the above object can be achieved by containing a specific pigment in the thermal recording layer, and accomplished the present invention.

Specifically, the recording sheet according to the present invention relates to a thermal recording sheet comprising a substrate having thereon a thermal color developing layer containing a colorless or pale colored basic colorless dye and an organic color developer, wherein the thermal color developing layer contains aluminium hydroxide and a urea-formaldehyde resin pigment.

The aluminium hydroxide used in the present invention is an inorganic pigment having monoclinic crystal system in the form of hexagonal plate-formed crystals of chemical formula Al(OH), or $Al_2O_3.3H_2O$ and is not specifically limited but, since contamination of crystals of excessively large particle diameters or aggregates may degrade the recording image quality, an average particle diameter of less than 15 μm is preferable, and that of 0.5 to 10 μm is more preferable in view of the coating adaptability in the recording sheet production process.

The urea-formaldehyde resin pigment used in the present invention is aggregate particles of primary particles produced by condensation and cross linking of mainly urea and formaldehyde. As materials other than urea and formaldehyde, cross-linking compounds such as melamine, acetaldehyde, and the like are also added as necessary. However, since a polyamine tends to cause insufficient color development or discoloration during thermal recording, use of it should be avoided. Preferable shape of the urea-formaldehyde resin pigment is, for example, aggregate particles of primary particles of a particle diameter of 0.05 to 0.3 μm. When the urea-formaldehyde resin pigment is filled sphericity particles, it is liable to increase adherence of depositions, and tends to generate conspicuous sticking.

Further, the aggregate particles of an average diameter of preferably 1 to 10 μm, more preferably 2 to 7 μm, are selected. If the particle diameter exceeds 10 μm, unrecorded portions may be produced to degrade the recording image quality. On the other hand, if the particle diameter is less than 1 μm, adherence of depositions to the head and staining of unrecorded portions due to friction will increase.

Linkage of primary particles is controlled by the molar ratio of urea and formaldehyde, reaction pH value, catalyst, reaction temperature, or the like. The resulting aggregate particles are selected which have an oil absorption, measured by the method specified in JISK-5101, in the range of 200 to 1000 ml/100 g. When the value is less than 200 ml/100 g, adherence of depositions is increased and the long-run recording adaptability is decreased. When the value exceeds 1000 ml/100 g, the surface strength of the color developing layer is decreased, which also decreases the long-run recording adaptability.

In the thermal recording sheet of the present invention, the ratio of aluminium hydroxide and urea-formaldehyde resin pigment is 1:1 to 5:1, more preferably 2:1 to 4:1. Within the specified range, friction staining by the recording head of unrecorded portion is efficiently suppressed. When the ratio of urea-formaldehyde resin pigment to aluminium hydroxide is more than the above range, the surface strength is decreased the printability, and decreases in color developing sensitivity and image uniformity. Further, the coating layer becomes liable to peel. On the other hand, when the ratio of the urea-formaldehyde resin pigment is less than the above range, changes in gloss become large during printing, which impairs the appearance.

Contents of the aluminium hydroxide and the urea-formaldehyde resin pigment in the thermal recording layer are 5 to 60 parts by weight of aluminium hydroxide and 3 to 30 parts by weight of urea-formaldehyde resin pigment in 100 parts by weight (absolute dry) of the thermal recording layer materials, more preferably 20 to 50 parts by weight and 5 to 20 parts by weight, respectively. When these contents are exceeded, the color developing sensitivity is decreased and the image quality is degraded. When the contents are less than the specified values, adherence of depositions becomes considerable during printing.

The colorless or pale colored basic colorless dye used in the thermal recording sheet of the present invention can by those which are normally used in the thermal recording area and are not specifically limited, but triphenylmethane type compounds, fluoran type compounds, fluorene type compounds, and divinyl type compounds are preferably used. Typical examples of these dyes are shown below. These dyes may be used alone or in combination of two or more types.

<Triphenylmethane Type Leuco Dyes>

3,3-Bis(p-dimethylaminophenyl)-6-dimethylaminophthalide [Crystal Violet Lactone].

<Fluoran Type Leuco dyes (I)>

3-Diethylamino-6-methyl-7-anilinofluoran, 3-(N-ethyl-p-toluidino)-6-methyl-7-anilinofluorane, 3-(N-ethyl-N-isoamylamino)-6-methyl-7-anilino)fluoran, 3-Diethylamino-6-methyl-7-(o,p-dimethylanilino)fluoran, 3-Pyrrolidino-6-methyl-7-anilinofluoran, 3-Piperidino-6-methyl-7-anilinofluoran, 3-(N-cyclohexyl-N-methylamino)-6-methyl-7-anilinofluoran, 3-Diethylamino-7-(m-trifluoromethylanilino)fluoran, 3-N-n-dibutylamino-6-methyl-7-anilinofluoran, 3-N-n-dibutylamino-7-(o-chloroanilino)fluoran, 3-(N-ethyl-N-tetrahydrofurfurylamino)-6-methyl-7-anilinofluoran, 3-Dibutylamino-6-methyl-7-(o,p-dimethylanilino)fluoran, 3-(N-methyl-N-propylamino)-6-methyl-7-anilinofluoran, 3-Diethylamino-6-chloro-7-anilinofluoran, 3-Dibutylamino-7-(o-chloroanilino)fluoran, 3-Diethylamino-7-(o-chloroanilino)fluoran, 3-Diethylamino-6-methyl-chlorofluoran, 3-Diethylamino-6-methyl-fluoran, 3-Cyclohexylamino-6-chlorofluoran, 3-Diethylamino-benzo[a]-fluoran, 3-n-Dipentylamino-6-methyl-7-anilinofluoran, 2-(4-Oxo-hexyl)-3-dimethylamino-6-methyl-7-anilinofluoran, 2-(4-Oxo-hexyl)-3-diethylamino-6-methyl-7-anilinofluoran, 2-(4-Oxo-hexyl)-3-dipropylamino-6-methyl-7-anilinofluoran.

<Fluoran Type Leuco Dyes>

3,6,6'-Tris(dimethylamino)spiro[fluorene-9,3'-phthalide], 3,6,6'-Tris(diethylamino)spiro[fluorene-9,3'-phthalide]

<Fluoran Type Leuco Dyes (II)>

2-Methyl-6-p-(p-dimethylaminophenyl)aminoanilinofluoran, 2-Methoxy-6-p-(p-dimethylaminophenyl)aminoanilinofluoran, 2-Chloro-3-methyl-6-p-(p-phenylaminophenyl)aminoanilino fluoran, 2-Chloro-6-p-(p-dimethylaminophenyl)aminoanilinofluoran, 2-Nitro-6-p-(p-diethylaminophenyl)aminoanilinofluoran, 2-Amino-6-6-p-(p-diethylaminophenyl)aminoanilinofluoran, 2-Diethylamino- 6-p-(p-diethylaminophenyl)aminoanilino fluoran, 2-Phenyl-6-metyl-p-(p-phenylaminophenyl)aminoanilinofluoran, 2-Benzyl-6-p-(p-phenylaminophenyl)aminoanilinofluoran, 2-Hydroxy-6-p-(p-phenylaminophenyl) aminoanilinofluoran, 3-Methyl-6-p-(p-dimethylaminophenyl)aminoanilinofluoran, 3-Diethylamino-6-p-(p-diethylaminophenyl)aminoanilino fluoran, 3-Diethylamino-6-p-(p-dibutylaminophenyl) aminoanilino fluoran <Divinyl Type Leuco Dyes>

3,3-Bis-[2-(p-dimethylaminophenyl)-2-(p-methoxyphenyl) ethenyl]4,5,6,7-tetrabromophthalide, 3,3-Bis-[2-(p-dimethylaminophenyl)-2-(p-methoxyphenyl) ethenyl]-4,5,6,7-tetrachlorophthalide, 3,3-Bis-[1,1-bis(4-pyrrolidinophenyl)ethylen-2-yl]-4,5,6,7-tetrabromophthalide, 3,3-Bis-[1-(4-methoxyphenyl)-1-(4-pyrrolidinophenyl)ethylen-2-yl]-4,5,6,7-tetrachlorophthalide.

<Others>

1,1-Bis-[2',2',2",2"-tetrakis-(p-dimethylaminophenyl)-ethenyl]-2,2-dinitrileethane, 1,1-Bis-[2',2',2",2"-tetrakis-(p-dimethylaminophenyl)-ethenyl]-2-β-naphthoylethane, 1,1-Bis-[2',2',2",2"-tetrakis-(p-dimethylaminophenyl)-ethenyl]-2,2-diacetylethane, Bis-[2,2,2',2'-tetrakis-(p-dimethylaminophenyl)-ethenyl]-methylmalonic acid dimethyl ester.

The organic color developer used in the thermal recording sheet of the present invention can be the following bisphenols A compounds, 4-hydroxybenzoic acid esters, 4-hydroxyphthalic acid diesters, phthalic acid monoesters, bis-(hydroxyphenyl) sulfides, 4-hydroxyphenylarylsulfones, 4-hydroxyphenylarylsulfonates, 1,3-di[2-(hydroxyphenyl)-2-propyl]-benzenes, 4-hydroxybenzoyloxybenzoic acid esters and bisphenol sulfones.

Further, in the present invention, these organic color developers can be used alone or in combination of two or more types.

<Bisphenols A>

4,4'-Isopropylidene diphenol (Bisphenol A), 4,4'-Cyclohexylidene diphenol, p,p'-(1-Methyl-n-hexylidene) diphenol, 1,7-Di(4-hydroxyphenylthio)-3,5-dioxaheptane.

<4-Hydroxybenzoic Acid Esters>

Benzyl 4-hydroxybenzoate, Ethyl 4-hydroxybenzoate, Propyl 4-hydroxybenzoate, Isopropyl 4-hydroxybenzoate, Butyl 4-hydroxybenzoate, Isobutyl 4-hydroxybenzoate, Methylbenzyl 4-hydroxybenzoate.

<4-Hydroxyphthalic acid diesters>

Dimethyl 4-hydroxyphthalate, Diisopropyl 4-hydroxy phthalate, Dibenzyl 4-hydroxyphthalate, Dihexyl 4-hydroxyphthalate.

<Phthalic Acid Monoesters>

Monobenzyl phthalate, Monocyclohexyl phthalate, Monophenyl phthalate, Monomethylphenyl phthalate, Monoethylphenyl phthalate, Monopropylbenzyl phthalate, Monohalogenbenzyl phthalate, Monoethoxybenzyl phthalate.

<Bis-(hydroxyphenyl)-sulfides>

Bis-(4-hydroxy-3-tert-butyl-6-methylphenyl)sulfide, Bis-(4-hydroxy-2,5-dimethylphenyl)sulfide, Bis-(4-hydroxy-2-methyl-5-ethylphenyl)sulfide, Bis-(4-hydroxy-2-methyl-5-isopropylphenyl)sulfide, Bis-(4-hydroxy-2,3-dimethylphenyl)sulfide, Bis-(4-hydroxy-2,5-dimethylphenyl)sulfide, Bis-(4-hydroxy-2,5-diisopropylphenyl)sulfide, Bis-(4-hydroxy-2,3,6-trimethylphenyl)sulfide, Bis-(2,4,5-trihydroxyphenyl) sulfide, Bis-(4-hydroxy-2-cyclohexyl-5-methylphenyl) sulfide, Bis-(2,3,4-trihydroxyphenyl)sulfide, Bis-(4,5-dihydroxy-2-tert-butylphenyl)sulfide, Bis-(4-hydroxy-2,5-diphenylphenyl)sulfide, Bis-(4-hydroxy-2-tert-octyl-5-methylphenyl)sulfide.

<4-Hydroxyphenylarylsulfones>

4-Hydroxy-4'-isopropoxydiphenylsulfone, 4-Hydroxy-4'-propoxydiphenylsulfone, 4-Hydroxy-4'-n-butyloxydiphenylsulfone, 4-Hydroxy-4'-n-propoxydiphenylsulfone.

<4-Hydroxyphenylarylsulfonates>

4-Hydroxyphenylbenzenesulfonate, 4-Hydroxyphenyl-p-tolylsulfonate, 4-Hydroxyphenylmethylenesulfonate, 4-Hydroxyphenyl-p-chlorobenzenesulfonate, 4-Hydroxyphenyl-p-tert-butylbenzenesulfonate, 4-Hydroxyphenyl-p-isopropoxybenzenesulfonate, 4-Hydroxyphenyl-1'-naphthalenesulfonate, 4-Hydroxyphenyl-2'-naphthalenesulfonate.

<1,3-Di[2-(hydroxyphenyl)-2-propyl]benzenes>

1,3-Di[2-(4-hydroxyphenyl)-2-propyl]benzene, 1,3-Di[2-(4-hydroxy-3-alkylphenyl)-2-propyl]benzene, 1,3-Di[2-(2,4-dihydroxyphenyl)-2-propyl]benzene, 1,3-Di[2-(2-hydroxy-5-methylphenyl)-2-propyl]benzene <Resorcinols>

1,3-Dihydroxy-6(a,a-dimethylbenzyl)-benzene.

<4-Hydroxybenzoyloxybenzoic Acid Esters>

Benzyl 4-hydroxybenzoyloxybenzoate, Methyl 4-hydroxybenzoyloxybenzoate, Ethyl 4-hydroxybenzoyloxybenzoate, Propyl 4-hydroxybenzoyloxybenzoate, Butyl 4-hydroxybenzoyloxybenzoate, Isopropyl 4-hydroxybenzoyloxybenzoate, tert-Butyl 4-hydroxybenzoyloxybenzoate, Hexyl 4-hydroxybenzoyloxybenzoate, Octyl 4-hydroxybenzoyloxybenzoate, Nonyl 4-hydroxybenzoyloxybenzoate, Cyclohexyl 4-hydroxybenzoyloxybenzoate, b-Phenethyl 4-hydroxybenzoyloxybenzoate, Phenyl 4-hydroxybenzoyloxybenzoate, a-Naphthyl 4-hydroxybenzoyloxybenzoate, b-Naphthyl 4-hydroxybenzoyloxybenzoate, sec-Butyl 4-hydroxybenzoyloxybenzoate.

<Bisphenolsulfones (I)>

Bis-(3-1-butyl-4-hydroxy-6-methylphenyl)sulfone, Bis-(3-ethyl-4-hydroxyphenyl)sulfone, Bis-(3-propyl-4-hydroxyphenyl)sulfone, Bis-(3-methyl-4-hydroxyphenyl) sulfone, Bis-(2-isopropyl-4-hydroxyphenyl)sulfone, Bis-(2-ethyl-4-hydroxyphenyl)sulfone, Bis-(3-chloro-4-hydroxyphenyl)sulfone, Bis-(2,3-dimethyl-4-hydroxyphenyl)sulfone, Bis-(2,5-dimethyl-4-hydroxyphenyl)sulfone, Bis-(3-methoxy-4-hydroxyphenyl) sulfone, 4-Hydroxyphenyl-2'-ethyl-4'- hydroxyphenylsulfone, 4-Hydroxyphenyl-2'-isopropyl-4'-hydroxyphenylsulfone, 4-Hydroxyphenyl-3'-isopropyl-4'-hydroxyphenylsulfone, 4-Hydroxyphenyl-3'-sec-butyl-4'-hydroxyphenylsulfone, 3-Chloro-4-hyydroxyphenyl-3'-isopropyl-4'-hydroxyphenyl sulfone, 2-Hydroxy-5-t-butylphenyl-4'-hydroxyphenylsulfone, 2-Hydroxy-5-t-aminophenyl-4'-hydroxyphenylsulfone, 2-Hydroxy-5-t-isopropylphenyl-4'-hydroxyphenylsulfone, 2-Hydroxy-5-t-octylphenyl-4'-hydroxyphenylsulfone, 2-Hydroxy-5-t-butylphenyl-3'-chloro-4'-hydroxyphenylsulfone, 2-Hydroxy-5-t-butylphenyl-3'-methyl-4'-hydroxyphenylsulfone, 2-Hydroxy-5-t-butylphenyl-3'-isopropyl-4'-hydroxyphenyl sulfone, 2-Hydroxy-5-t-butylphenyl-3'-chloro-4'-hydroxyphenyl sulfone, 2-Hydroxy-5-t-butylphenyl-3'-methyl-4'-hydroxyphenylsulfone, 2-Hydroxy-5-t-butylphenyl-3'-isopropyl-4'-hydroxyphenyl sulfone, 2-Hydroxy-5-t-butylphenyl-2'-methyl-4'-hydroxyphenylsulfone.

Bisphenolsulfones (II)>

4,4'-Sulfonyldiphenol, 2,4'-Sulfonyldiphenol, 3,3'-Dichloro-4,4'-sulfonyldiphenol, 3,3'-Dibromo-4,4'-sulfonyldiphenol, 3,3',5,5'-Tetrabromo-4,4'-sulfonyldiphenol, 3,3'-Diamino-4,4'-sulfonyldiphenol.

<Others> p-tert-Butylphenol, 2,4-Dihydroxybenzophenone, Novolac type phenolic resin, 4-Hydroxyacetophenone, p-Phenylphenol, Benzyl-4-hydroxyphenylacetate, p-Benzylphenol.

Further, as a sensitizer, a fatty acid amide such as stearamide or palmitamide; ethylene-bisamide, montan wax, polyethylene wax, dibenzyl terephthalate, benzyl p-benzyloxybenzoate, di-p-tolylcarbonate, p-benzylbiphenyl, phenyl-a-naphthylcarbonate, 1,4-diethoxynaphthalene, 1-hydroxy-2-naphthoic acid phenyl ester, 1,2-di-(3-methylphenoxy)ethane, di(p-methylbenzyl) oxalate, b-benzyloxynaphthalene, 4-biphenyl-p-tolylether, o-xylylene-bis-(phenylether), 4-(m-methylphenoxymethyl) biphenyl, or the like can be added to the thermal recording layer.

The binder used in the present invention includes completely-hydrolyzed polyvinylacohol having a polymerization degree of 200 to 1900, partially-hydrolyzed polyvinylalcohol, carboxy-modified polyvinylalcohol, amide-modified polyvinylalcohol, sulfonic acid-modified polyvinylalcohol, butyral-modified polyvinylalcohol, other modified polyvinylalcohols, hydroxyethylcellulose, methylcellulose, carboxymethylcellulose, styrene-maleic anhydride copolymer, styrene-maleic anhydride copolymer, styrene-butadiene copolymer, cellulose derivatives such as ethylcellulose and acetylcellulose, polyvinylchloride, polyvinylacetate, polyacrylamide, polyacrylic acid esters, polyvinylbutyral, polystyrene, and copolymers thereof, polyamide resins, silicone resins, petroleum resins, terpene resins, ketone resins, and coumarone resins. These polymeric substances are used by dissolving in solvents such as water, alcohol, ketone, ester, and hydrocarbon, emulsifying or dispersing in a paste form in water or other solvents, and can be used in combination according to the quality requirements.

In addition to the above, it is also possible to use release agents such as fatty acid metal salts, slip agents such as waxes, benzophenone- or triazole-based ultraviolet absorbers, water resistant agents such as glyoxal, dispersants, defoamers, and the like.

The amounts of the color developer and the basic colorless dye used in the present invention and the types and amounts of other constituents are determined according to the required properties and recording adaptability, and are not specifically limited, but it is usually preferable to use 1 to 8 parts of the color developer and 1 to 8 parts of the sensitizer based on 1 part of the basic colorless dye, and it is appropriate to use the binder in an amount of 10 to 25% of the total solid.

The organic color developer, the basic colorless dye, and the materials which are added as necessary are finely divided by a grinding machine such as a ball mill, an attriter, or a sand grinder, or by an appropriate emulsifying apparatus, to a particle diameter of less than several microns, and mixed with the binder and various additives according to the purpose to obtain a coating color. The coating color of the above composition is coated on any type of substrate such as paper, synthetic paper, plastic films, non-woven fabrics, or the like to obtain the objective thermal recording sheet.

The coating method is not specifically limited, but the layer can be coated by a conventional method known in the art. For example, a size press, a roll coater, a blade coater, a bar coater, an air knife coater, a curtain coater, a gravure coater, or the like can be appropriately used. Further, after the layer is coated and dried, it may be surface treated by a metal roll, a cotton roll, a resin roll, or combinations thereof to control the surface properties of the recording medium.

Furthermore, the thermal recording sheet of the present invention can be provided with an undercoating layer containing an organic or inorganic filler between the substrate and the thermal color developing layer to enhance the storage stability and sensitivity.

In the present invention, by containing aluminium hydroxide and urea-formaldehyde resin pigment in the thermal color developing layer, a thermal recording sheet can be obtain which is specifically small in abrasion of recording head during extended recording, small in adherence of depositions to the head, and prevented from friction staining of unrecorded portion and changing in gloss, The reason for this function has yet to be elucidated but is considered as follows.

Aluminium hydroxide, which releases hydroxyl groups (—OH) in water, has a weak cationic property on the surface of the particles. On the other hand, the urea-formaldehyde resin pigment also has a weak cationic property due to the fact that the amino group linked with the methylene group having an induction effect in the resin chemical structure interact the carbonyl group having an electron attracting. Therefore, aluminium hydroxide and urea-formaldehyde resin pigment moderately repulse each other in the coating color and, as a result, a porous structure is formed in the color developing layer and the oil absorptivity is increased. Therefore, a melt of the heat sensitive materials causing the depositions go into the porous portions, which suppresses adherence of depositions and occurrence of sticking.

Further, the porous structure formed by repulsion between aluminium hydroxide and urea-formaldehyde resin pigment has a role of somewhat of a cushion material to the printing head, thereby preventing friction staining and change in gloss during printing. Still further, it is also considered as due to the fact that the surface is flat, thus a physical abrasion of the head can be minimized even when printed for an extended period of time, and a uniform image can be obtained without a reduction in color developing sensitivity.

Yet further, it can be considered that, since, aluminium hydroxide is high in degree of releasing hydroxy group (—OH) and thus liable to form a porous structure, and the crystalline structure itself is a hexagonal plate-formed which is less liable to cause head abrasion, the effect of the present invention is efficiently provided as compared with other fillers.

DETAILED DESCRIPTION OF EXAMPLES

The present invention will be described in detail with reference to the examples, but the present invention is not limited to these examples. In the description, "part" and "%" indicate part by weight and % by weight, respectively, unless otherwise noted.

EXAMPLE 1

Liquid A (color developer dispersion)

4,4'-Isopropylidenediphenol 6.0 parts

10% Aqueous polyvinylalcohol solution 18.8

Water 11.2

Liquid B (dye dispersion)

3-(N-ethyl-N-isoamylamino)-6-methyl-7-anilinofluoran 2.0 parts

10% Aqueous polyvinylalcohol solution 4.6

Water 2.6

Liquid C (sensitizer dispersion)

4-Biphenyl-p-tolylether 4.0 parts

10% Aqueous polyvinylalcohol solution 5.0

Water 3.0

The liquids of the above compositions were milled by a sand grinder to an average particle diameter of 1 micron, and mixed in the following ratio to obtain a coating color.

Liquid A 36.0 parts

Liquid B 9.2

Liquid C 12.0

Aluminium hydroxide slurry (average particle diameter: 1.7 μm: 60% dispersion) 12.0 parts Urea-formaldehyde resin pigment (a) slurry (primary particle diameter: 0.13 μm, aggregate particle average diameter: 2 μm, oil absorption 300 ml/100 g: 10% dispersion) 25.0 parts The coating color was coated on one side of a 50 g/m$^2$ base paper to a coating amount of 6.0 g/m$^2$, dried, and supercalendered to a flatness of 500 to 600 seconds to obtain a thermal recording sheet.

EXAMPLE 2

Using the same procedure as in Example 1, except that the aluminium hydroxide slurry was used in an amount of 25.0 parts and the urea-formaldehyde resin pigment a slurry was used in an amount of 37 parts in the preparation of the coating color, to obtain a thermal recording sheet.

EXAMPLE 3

Using the same procedure as in Example 1, except that the aluminium hydroxide slurry was used in an amount of 9.0 parts and the urea-formaldehyde resin pigment a slurry was used in an amount of 40.0 parts in the preparation of the coating color, to obtain a thermal recording sheet.

EXAMPLE 4

A thermal recording sheet was obtained using the same procedure as in Example 1, except that in the preparation of the coating color, the urea-formaldehyde resin pigment a slurry was replaced with 25.0 parts of a urea-formaldehyde resin pigment (b) slurry (primary particle diameter: 0.15 μm, aggregate particle average diameter: 5 μm, oil absorption: 400 ml/100 g: 10% dispersion).

Comparative Example 1

A thermal recording sheet was obtained using the same procedure as in Example 1, except that in the preparation of the coating color, the urea-formaldehyde resin pigment a slurry was removed and the aluminium hydroxide slurry was used in an amount of 16 parts.

Comparative Example 2

A thermal recording sheet was obtained using the same procedure as in Example 1, except that in the preparation of the coating color, the aluminium hydroxide slurry was removed and the urea-formaldehyde resin pigment a slurry was used in an amount of 80 parts.

Comparative Example 3

A thermal recording sheet was obtained using the same procedure as in Example 1, except that in the preparation of the coating color, the aluminium hydroxide slurry was used in an amount of 10.0 parts and the urea-formaldehyde resin pigment a slurry was used in an amount of 80 parts.

Comparative Example 4

125 Grams of urea was dissolved in 500 ml of water, 335 g of 36% formaldehyde was added under agitation, sodium hydroxide was added to adjust the pH value to 7.0, heated to 70° C., reaction was continued for about 2 hours, and then cooled to 50° C. With the reaction mixture, 7 g of 3% sulfamic acid was mixed, and maintained at 65° C. for about 2 hours. The resulting gel was divided by a granulator into slurry, pH value is adjusted to 7.5 by a sodium carbonate solution, filtered, dried, crushed by a ball mill or the like to a particle diameter of 3 μm to a 13% dispersion, to obtain a urea-formaldehyde resin pigment (c) slurry as filled sphericity particles.

A thermal recording sheet was obtained using the same procedure as in Example 1, except that in the preparation of the coating color, the urea-formaldehyde resin pigment c slurry (average particle diameter: 3 μm: 13% dispersion) was used in an amount of 19 parts.

Comparative Example 5

A thermal recording sheet was obtained using the same procedure as in Example 1, except that in the preparation of the coating color, a polystyrene resin slurry (primary particle diameter: 0.1 μm, aggregate particle average diameter: 1 μm: 20% dispersion) was used in an amount of 12.0 parts in place of the urea-formaldehyde resin pigment a slurry.

Comparative Example 6

A thermal recording sheet was obtained using the same procedure as in Example 1, except that in the preparation of the coating color, a polystyrene-methacrylic resin slurry (primary particle diameter: 0.1 μm, aggregate particle average diameter: 1 μm: 30% dispersion) was used in an amount of 8.0 parts in place of the urea-formaldehyde resin pigment a slurry.

Comparative Example 7

A thermal recording sheet was obtained using the same procedure as in Example 1, except that in the preparation of the coating color, a kaolin clay slurry (average particle diameter: 2.1 μm: 60% dispersion) was used in an amount of 12.0 parts in place of the aluminium hydroxide slurry.

Comparative Example 8

A thermal recording sheet was obtained using the same procedure as in Example 1, except that in the preparation of the coating color, a calcium carbonate slurry (average particle diameter: 2.5 μm: 30% dispersion) was used in an amount of 24.0 parts in place of the aluminium hydroxide slurry.

The thus obtained 12 types of thermal recording sheets were subjected to the following evaluation tests. The test results are shown in Table 1. The test methods were as follows.

(1) Recording Density: The thermal recording sheet was recorded using the Toshiba Thermal Word Processor RUPO JW90FII. The recorded image was measured for density by a Macbeth densitometer (RD-914, an amber filter used. Hereinafter density was measured in this condition).

(2) Head abrasion: Em-sized characters of 50 Km were continuously recorded by the Toshiba Thermal Word Processor RUPO JW90FII. The condition of the recording head was observed using an optical microscope.

Symbol: Description

A: Almost no head abrasion was noted.

B: Slight abrasion of head was noted.

C: Substantial abrasion of head was noted.

D: Head was broken before recording 50 Km.

(3) Image uniformity: Recorded image was visually observed for blank out.

A: Very good

B: Good

C: Fair

D: Poor (4) Sticking

A: Very quiet during recording

B: Quiet

C: High noise

D: Sticking pattern appears in the image.

(5) Adherence of Depositions

A: Very small

B: Small

C: Considerable (6) Change in gloss: 75° gloss of unrecorded portion was measured before and after recording, and a gloss change was determined by the following equation:

Gloss after recording (%)—gloss before recording (%)=change in gloss (%).

(7) Background staining of unrecorded portion: Unrecorded portion was observed for staining and trailing when recorded by the Toshiba Thermal Word Processor RUPO JW90FII.

A: None

B: Small

C: Slight

D: Considerable

TABLE 1

| | Quality test results | | | | | | |
|---|---|---|---|---|---|---|---|
| | Recording density (1) | Head abrasion (2) | Image uniformity (3) | Stick (4) | Deposition adherence (5) | Gloss change (6) | Ground stain (7) |
| Example 1 | 1.22 | A | A | A | A | 21 | A |
| Example 2 | 1.16 | A | B | A | A | 19 | A |
| Example 3 | 1.20 | A | A | A | A | 20 | A |
| Example 4 | 1.17 | A | B | A | A | 18 | A |
| Comp. EX. 1 | 1.24 | A | A | C | C | 35 | D |
| Comp. EX. 2 | 1.09 | A | D | B | B | 20 | C |
| Comp. EX. 3 | 0.99 | A | D | A | A | 24 | B |
| Comp. EX. 4 | 1.21 | A | B | D | C | 31 | D |
| Comp. EX. 5 | 1.21 | B | B | D | C | 30 | D |
| Comp. EX. 6 | 1.18 | B | B | D | C | 28 | D |
| Comp. EX. 7 | 1.15 | D | B | C | C | 35 | C |
| Comp. EX. 8 | 1.17 | C | B | C | C | 26 | C |

<Evaluation of the Quality Test Results>

As can be seen from the quality test results shown in Table 1, thermal recording sheets were obtained which are superior in head abrasion, sticking, and prevention of deposition adherence, small in gloss change during recording, with no background staining in Examples 1 to 4 which satisfy the requirements of the present invention. On the other hand, In Comparative Example 1 which does not contain the urea-formaldehyde resin pigment, the recording sheet was inferior in sticking and deposition adherence, large in gloss change, and high in background staining.

In Comparative Example 2 which does not contain aluminium hydroxide, although the change in gloss was small, the color developing sensitivity and image, uniformity were considerably degraded.

In Comparative Example 3 which does not contain aluminium hydroxide and the urea-formaldehyde resin in the ratio specified in the present invention, and the content of urea-formaldehyde resin is larger than specified, although sticking and deposition adherence were prevented, but the color developing sensitivity and image uniformity were considerably degraded.

In Comparative Example 4 which uses filled sphericity particles of urea-formaldehyde resin pigment in place of the aggregate particles of urea-formaldehyde resin pigment, prevention of sticking deposition adherence was inferior, and considerable gloss change and ground staining were noted.

In Comparative Example 5 and Comparative Example 6 which use other resins in place of the urea-formaldehyde resin pigment, prevention of sticking deposition adherence was inferior, and considerable gloss change and ground staining were noted.

In Comparative Example 7 and Comparative Example 8 which use other inorganic pigments in place of aluminium hydroxide, head abrasion occurred, and gloss change was large. Further, prevention of sticking, deposition adherence, and ground staining was inferior.

The thermal recording sheet of the present invention is a very useful thermal recording sheet that, even in long-run recording for an extended period of time, is small in abrasion of the recording head, and superior in prevention of deposition adherence and sticking to the recording head. Further, it is a very practical thermal recording sheet which is small in uneven recording, it provides small, the recorded image is uniform, and it is small in ground staining and gloss change of the surface.

What is claimed is:

1. A thermal recording sheet comprising a substrate having thereon a thermal color developing layer comprising a colorless or pale colored basic achromatic dye and an organic color developer, said thermal color developing layer containing aluminium hydroxide and an urea-formaldehyde resin pigment.

2. The thermal recording sheet of claim 1, wherein said urea-formaldehyde resin pigment comprises aggregate particles of primary particles, said aggregate particles have an average particle diameter of 1 to 10 μm and an oil absorption of 200 to 1000 ml/100 g.

3. The thermal recording sheet of claim 1 or claim 2, wherein said aluminium hydroxide and said urea-formaldehyde resin pigment in said thermal color developing layer are contained in a ratio of 1:1 to 5:1.

4. A thermal recording sheet comprising a substrate having thereon a thermal color developing layer comprising a colorless or pale colored basic achromatic dye, an organic color developer, aluminum hydroxide particles in an amount of 5 to 60 parts by weight and urea-formaldehyde resin pigment particles in an amount of 3 to 30 parts by weight, wherein said aluminum hydroxide and said urea-formaldehyde resin pigment articles in said thermal color developing layer are in a ratio of 1:1 to 5:1.

5. The thermal recording sheet of claim 4, wherein said thermal color developing layer comprises the colorless or pale colored basic achromatic dye and 1–8 parts by weight of organic color developer, base on 1 part by weight of said achromatic dye.

6. The thermal recording sheet of claim 4, containing 10–25% by weight of a binder, based on the total solid content of the thermal color developing layer.

7. The thermal recording sheet of claim 4, wherein the aluminum hydroxide particles have an average particle size of 0.5 to 10 μm.

8. The thermal recording sheet of claim 4, wherein the urea-formaldehyde resin pigment particles have an average particle size of 1–10 μm.

9. The thermal recording sheet of claim 4, wherein said urea-formaldehyde resin pigment particles consist essentially of aggregate particles having an average particle diameter of 1 to 10 μm, made up of primary particles having a particle diameter of 0.05 to 0.3 μm, and said aggregate particles having an oil absorption of 200 to 1000 ml/100 g of said aggregate particles.

10. A thermal recording sheet comprising a substrate having thereon a thermal color developing layer comprising a colorless or pale colored basic achromatic dye, an organic color developer, aluminum hydroxide particles in an amount of 20 to 50 parts by weight and urea-formaldehyde resin pigment particles in an amount of 5 to 20 parts by weight, wherein said aluminum hydroxide and said urea-formaldehyde resin pigment particles in said thermal color developing layer are in a ratio of 2:1 to 4:1.

11. The thermal recording sheet of claim 10, wherein said thermal color developing layer comprises the colorless or pale colored basic achromatic dye and 1–8 parts by weight of organic color developer, base on 1 part by weight of said achromatic dye.

12. The thermal recording sheet of claim 10, containing 10–25% by weight of a binder, based on the total solid content of the thermal color developing layer.

13. The thermal recording sheet of claim 10, wherein the aluminum hydroxide particles have an average particle size of 0.5 to 10 μm.

14. The thermal recording sheet of claim 10, wherein the urea-formaldehyde resin pigment particles have an average particle size of 2–7 μm.

15. The thermal recording sheet of claim 10, wherein said urea-formaldehyde resin pigment particles consist essentially of aggregate particles having an average particle diameter of 2 to 7 μm, made up of primary particles having a particle diameter of 0.05 to 0.3 μm, and said aggregate particles having an oil absorption of 200 to 1000 ml/100 g of said aggregate particles.

16. A thermal recording sheet comprising a substrate having thereon a thermal color developing layer comprising a colorless or pale colored basic achromatic dye and 1–8 parts by weight organic color developer, based on 1 part by weight of said basic achromatic dye, aluminum hydroxide particles in an amount of 5 to 60 parts by weight and urea-formaldehyde resin pigment particles in an amount of 3 to 30 parts by weight, wherein said aluminum hydroxide and said urea-formaldehyde resin pigment particles in said thermal color developing layer are in a ratio of 1:1 to 5:1, and 10–25% by weight of a binder, based on the total solid content of the thermal color developing layer.

17. The thermal recording sheet of claim 16, wherein the aluminum hydroxide particles have an average particle size of 0.5 to 10 μm.

18. The thermal recording sheet of claim 16, wherein the urea-formaldehyde resin pigment particles have an average particle size of 1–10 μm.

19. The thermal recording sheet of claim 16, wherein said urea-formaldehyde resin pigment particles consist essentially of aggregate particles having an average particle diameter of 1 to 10 μm, made up of primary particles having a particle diameter of 0.05 to 0.3 μm, and said aggregate particles having an oil absorption of 200 to 1000 ml/100 g of said aggregate particles.

* * * * *